US012753551B2

(12) United States Patent
Heiskanen et al.

(10) Patent No.: US 12,753,551 B2
(45) Date of Patent: Oct. 6, 2026

(54) METHOD FOR FRACTIONATION OF HIGHLY REFINED CELLULOSE

(71) Applicant: Stora Enso OYJ, Helsinki (FI)

(72) Inventors: Isto Heiskanen, Imatra (FI); Kaj Backfolk, Lappeenranta (FI); Jukka Kankkunen, Imatra (FI); Anna Kauppi, Lappeenranta (FI)

(73) Assignee: Stora Enso OYJ, Helsinki (FI)

( * ) Notice: Subject to any disclaimer, the term of this patent is extended or adjusted under 35 U.S.C. 154(b) by 359 days.

(21) Appl. No.: 18/548,367

(22) PCT Filed: Mar. 8, 2022

(86) PCT No.: PCT/IB2022/052036
§ 371 (c)(1),
(2) Date: Aug. 30, 2023

(87) PCT Pub. No.: WO2022/189957
PCT Pub. Date: Sep. 15, 2022

(65) Prior Publication Data

US 2024/0141588 A1 May 2, 2024

(30) Foreign Application Priority Data

Mar. 10, 2021 (SE) ..... 2150273-7

(51) Int. Cl.

| | |
|---|---|
| ***D21C 9/18*** | (2006.01) |
| ***D21C 11/00*** | (2006.01) |
| ***D21D 5/02*** | (2006.01) |
| ***D21D 99/00*** | (2006.01) |
| ***D21F 1/00*** | (2006.01) |

(52) U.S. Cl.
CPC ..... *D21C 9/18* (2013.01); *D21C 11/0042* (2013.01); *D21D 5/02* (2013.01); *D21D 99/00* (2013.01); *D21F 1/0009* (2013.01)

(58) Field of Classification Search
CPC ..... D21C 9/0007; D21D 99/00; D21D 5/02; D21F 1/0009
See application file for complete search history.

(56) References Cited

U.S. PATENT DOCUMENTS

| | | | | |
|---|---|---|---|---|
| 5,133,832 | A * | 7/1992 | Gilkey | D21C 5/025 162/6 |
| 10,240,288 | B2 | 3/2019 | Heiskanen et al. | |
| 11,192,987 | B2 | 12/2021 | Backfolk et al. | |
| 2010/0059190 | A1 | 3/2010 | Katajamaki et al. | |
| 2014/0315258 | A1* | 10/2014 | Nguyen | D21B 1/12 435/162 |
| 2018/0313034 | A1 | 11/2018 | Cowan et al. | |
| 2019/0234020 | A1* | 8/2019 | Backfolk | D21H 27/38 |
| 2019/0301094 | A1 | 10/2019 | Ramires et al. | |
| 2021/0395949 | A1* | 12/2021 | Silveira | D21D 1/30 |

FOREIGN PATENT DOCUMENTS

| | | | | |
|---|---|---|---|---|
| CA | 3140757 | A1 * | 1/2021 | D21H 27/30 |
| CN | 105051070 | A | 11/2015 | |
| CN | 110382601 | A | 10/2019 | |
| EP | 1798331 | A1 | 6/2007 | |
| WO | WO-9719198 | A1 * | 5/1997 | D21H 27/38 |
| WO | 2011113998 | A1 | 9/2011 | |
| WO | 2017046749 | A1 | 3/2017 | |
| WO | 2017168353 | A1 | 10/2017 | |
| WO | 2020095254 | A1 | 5/2020 | |
| WO | 2021001751 | A1 | 1/2021 | |

OTHER PUBLICATIONS

Nanko et al., The World of Market Pulp, 2005, WOMP LLC, p. 222-223 (Year: 2005).*

Editorial Committee of "Complete Collection of Chinese Chemical Machinery and Equipment Purchase and Sale, Complete Collection of Chinese Chemical Machinery and Equipment—Special Volume on Modeling and Purchase and Sale", p. 179, Chengdu: Chengdu University of Science and Technology Press, Dec. 1993.

Chinese Office Action from corresponding Chinese patent application No. 202280019808.7 dated Jul. 31, 2025.

International Search Report from corresponding PCT application No. PCT/IB2022/052036, mailed Apr. 27, 2022.

Atsushi Tanaka et al., Nanocellulose characterization with mechanical fractionation, Nordic Pulp and Paper Research Journal, vol. 27, No. 4, 2012.

Per A. Larsson, Towards optimised size distribution in commercial microfibrillated cellulose: a fractionation approach, Cellulose (2019) 26:1565-1575.

Extended European Search Report and Office Action from corresponding European application No. 22766475.2, dated Jan. 8, 2025.

* cited by examiner

*Primary Examiner* — Anthony Calandra
(74) *Attorney, Agent, or Firm* — Greer, Burns & Crain, Ltd.

(57) ABSTRACT

The present invention relates to a method for fractionation of a highly refined cellulose pulp into a fine fraction and coarse fraction, said method comprising: a) providing a highly refined cellulose pulp suspension comprising highly refined cellulose pulp having a Schopper-Riegler (SR) number in the range of 40-98 as determined by standard ISO 5267-1 and a content of fibers having a length >0.2 mm of at least 7 million fibers per gram based on dry weight; b) subjecting the highly refined cellulose pulp suspension to dewatering in a belt filter; c) collecting the dewatered retentate as the coarse fraction; and d) collecting the filtrate as the fine fraction; wherein the collected fine fraction contains 2-50 wt % of the solids of the highly refined cellulose pulp suspension provided in step a).

16 Claims, No Drawings

METHOD FOR FRACTIONATION OF HIGHLY REFINED CELLULOSE

This application is a U.S. National Phase under 35 U.S.C. § 371 of International Application No. PCT/IB2022/052036, filed Mar. 8, 2022, which claims priority under 35 U.S.C. §§ 119 and 365 to Swedish Application No. 2150273-7 filed Mar. 10, 2021.

TECHNICAL FIELD

The present disclosure relates to methods for preparing highly refined cellulose, e.g. useful for manufacturing barrier films for paper and paperboard based packaging materials.

BACKGROUND

Effective gas, aroma, and/or moisture barriers are required in packaging industry for shielding sensitive products. Particularly, oxygen-sensitive products require an oxygen barrier to extend their shelf-life. Oxygen-sensitive products include many food products, but also pharmaceutical products and electronic industry products. Known packaging materials with oxygen barrier properties may be comprised of one or several polymer films or of a fibrous paper or board coated with one or several layers of an oxygen barrier polymer, usually as part of a multilayer coating structure. Another important property for packaging for food products is resistance to grease and oil.

More recently, films produced from highly refined cellulose and microfibrillated cellulose (MFC) have been developed, in which defibrillated cellulosic fibrils have been suspended e.g. in water, re-organized and rebonded together to form a continuous film. Such films have been found to provide good gas barrier properties as well as good resistance to grease and oil.

The films can be made by applying a highly refined cellulose suspension on a porous substrate forming a web followed by dewatering of the web by draining water through the substrate for forming the film. Formation of the web can be accomplished e.g. by use of a paper- or paperboard machine type of process. The porous substrate may for example be a membrane or wire fabric or it can be a paper or paperboard substrate.

Manufacturing of films and barrier substrates from highly refined cellulose or MFC suspensions on a paper machine is difficult because of the high water retention and/or high drainage resistance of the suspensions and the formed webs. Rapid or forced dewatering, e.g. assisted by pressure or suction tends to lead to high loss of fines from the web, or uneven vertical distribution of fines in the web, and formation of pinholes, resulting in a film with poor barrier properties. On the other hand, reducing the dewatering speed to prevent these problems will require excessively long dewatering sections.

A problem with webs and films formed from highly refined cellulose or MFC suspensions is that they will typically exhibit poor tensile and tearing strength.

From a technical and economical point of view, it would be preferable to find a solution that enables fast dewatering, and at the same time improves the film barrier and tear strength properties.

DESCRIPTION OF THE INVENTION

It is an object of the present disclosure to provide a method for treating highly refined cellulose pulp, which alleviates at least some of the above mentioned problems.

It is an object of the present disclosure to provide a method for decreasing the water retention and/or increasing the homogeneity of a highly refined cellulose pulp.

It is a further object of the present disclosure to provide a highly refined cellulose pulp suitable for manufacturing a barrier film in a paper- or paperboard machine type of process.

It is a further object of the present disclosure to provide a highly refined cellulose pulp suitable for manufacturing a barrier film based on renewable raw materials.

It is a further object of the present disclosure to provide a highly refined cellulose pulp suitable for manufacturing a barrier film with high repulpability, providing for high recyclability of packaging products comprising the barrier film.

The above-mentioned objects, as well as other objects as will be realized by the skilled person in the light of the present disclosure, are achieved by the various aspects of the present disclosure.

The present invention is based on the realization that a relatively small portion of fines in highly refined cellulose pulp suspensions is responsible to a high degree for the high water retention and/or high drainage resistance of the suspensions and the formed webs. Traditionally, when manufacturing barrier films it has been considered important to try to retain as much of the fines as possible in the web, as the fines are also responsible to a high degree for the barrier properties of the finished films. Accordingly, previous strategies for manufacturing barrier films from highly refined cellulose have focused on measures for retaining the fines in the web during forming and dewatering, such as addition of chemical retention agents.

The inventive method uses a belt filter normally used in washing conventional pulp suspensions for papermaking to fractionate the highly refined cellulose pulp to remove some of the fines in the pulp. Removing some of the fines provides a highly refined cellulose which allows for more efficient manufacturing of barrier films in a paper machine type of process. Such films are useful, e.g., as gas barrier films in packaging applications. The films can be used to replace conventional barrier films, such as synthetic polymer films or aluminum foils which reduce the recyclability of paper or paperboard packaging products. The inventive films have high repulpability, providing for high recyclability of the films and paper or paperboard packaging products comprising the films.

Many of the existing pulp fractionation methods are optimized for fractionation of normal pulp suspensions into coarse and fine fractions. Examples include hydrocyclones and pressure screens.

Hydrocyclones fractionate solids based on surface area. Experimental studies have shown that hydrocyclones separate fibers according to the specific surface area, specific volume and cell wall thickness. A problem with hydrocyclones is that they are less efficient at higher solids content, such as >0.9 wt %, due to flocculation.

Pressure screens fractionate solids based on size and flexibility. Particle acceptance is determined by fiber flexibility, length, and thickness in that order. Fibers of equal length are accepted by flexibility. Chemical fibers are more readily accepted than stiff mechanical fibers. Fibers of different length are accepted by length, and shorter fibers are accepted more readily than long fibers. In screening, lower solids makes it possible to use finer slits but this requires larger machinery and is thus less economically attractive.

The existing methods are not suitable for fractionation of suspensions comprising highly refined cellulose. Due to size difference and that different law of physics come into play, good efficiency and yield will be more difficult to achieve with highly refined cellulose.

According to a first aspect illustrated herein, there is provided a method for fractionation of a highly refined cellulose pulp into a fine fraction and coarse fraction, said method comprising:

a) providing a highly refined cellulose pulp suspension comprising highly refined cellulose pulp having a Schopper-Riegler (SR) number in the range of 40-98 as determined by standard ISO 5267-1 and a content of fibers having a length >0.2 mm of at least 7 million fibers per gram based on dry weight;

b) subjecting the highly refined cellulose pulp suspension to dewatering in a belt filter;

c) collecting the dewatered retentate as the coarse fraction; and d) collecting the filtrate as the fine fraction;

wherein the collected fine fraction contains 2-50 wt % of the solids of the highly refined cellulose pulp suspension provided in step a).

In this manner, fine and coarse materials can be separated. In contrast to papermaking wire/dewatering, the retention of fines in this system is preferably low so that fractionation and dewatering/drainage is more efficient.

The fractions obtained by the inventive method may advantageously be used for preparing a barrier film in a paper machine. Traditionally, when manufacturing barrier films it has been considered important to try to retain as much of the fines as possible in the web as it is formed and dewatered on the wire of the paper machine, as the fines are also responsible to a high degree for the barrier properties of the finished films. Accordingly, previous strategies for manufacturing barrier films from highly refined cellulose have focused on measures for retaining the fines in the web during forming and dewatering, such as addition of chemical retention agents.

The inventors have found that a coarse fraction obtained by the inventive method may be used in a pulp suspension for forming a substrate web in a paper machine. As the fines are responsible to a high degree for the high water retention of pulp suspensions, the reduced content of fines in the coarse fraction provides for enhanced forming and dewatering of the web. As the fines are also responsible to a high degree for the barrier properties of the films formed from a pulp, the reduced content of fines in the coarse fraction may in some cases lead to reduced barrier properties in a film formed from the coarse fraction alone. The present inventors have found that this deficiency can be remedied by applying a coating comprising cellulose fines or MFC to the substrate. A coating comprising cellulose fines or MFC, even at very low grammages, can heal defects in the substrate web, drastically improving the barrier properties of the web, such that a film suitable for use as a barrier film can be obtained. The fines used for the coating may preferably be fines obtained by fractionation of a highly refined cellulose pulp according to the invention. The fines used for the coating may for example comprise the fine fraction obtained when preparing the coarse fraction used for the substrate web. Thus, in some embodiments the fractionation may be seen as a means to achieve a redistribution of fines from the bulk of the web to the surface of the web. This redistribution of fines has several advantages.

The porous substrate web formed from the coarse fraction can be rapidly dewatered, and the porosity of the web also allows for rapid dewatering and drying of a coating comprising cellulose fines applied to the web. As a result, the inventive method allows for a rapid production of a film suitable for use as a barrier film.

Since pores and pinholes can be accepted in the substrate web, films with higher grammages which are difficult to dewater without pinhole formation can be manufactured.

The redistribution of fines from the bulk to the surface, resulting in a high local concentration of fines at the surface of the web, also allows for the total amount material in the barrier film to be reduced, while still providing similar barrier properties.

The redistribution of fines from the bulk to the surface, has also been found to lead to films with significantly higher tearing strength than a corresponding film formed from the entire highly refined pulp with the fines retained in the bulk.

A high concentration of fines at the surface of the web can also improve the response of the surface to calendering.

Due to their high surface area, fines bind chemicals to a higher extent than coarser particles. The redistribution of fines from the bulk to the surface leads to a more even distribution of the fines, and thereby also chemicals bound to the fines, across the surface area of the web.

Furthermore, the fractionation allows for addition of different chemicals in the fractionation and forming steps. For example, in the highly refined pulp suspension to be subjected to fractionation, no chemicals, or chemicals that aid the fractionation can be added. In an obtained coarse fraction for use in the formation of a substrate web, chemicals that aid the formation of a web may be added, and in a fine fraction for use in coating of the substrate web, suitable coating chemicals can be added. This way, the overall chemical consumption can be reduced and/or the web or film properties related to various chemicals can be improved.

The inventive method is performed in a belt filter. A belt filter, also known as a belt filter press, is a machine designed for treating pulps in conventional papermaking to increase pulp consistency by removing water. The pulp and paper making industry has for many years made regular use of such machines for washing and thickening pulp and paper stock, usually for storage or other temporary treatment purposes.

Although belt filters have been used for washing and thickening conventional pulps used in papermaking, they have not previously been used for fractionation of highly refined cellulose pulps in accordance with the present invention.

Exemplary belt filters include Double Wire Press (available from Andritz-Ahlstrom); BDP (available from Baker Process); Turbodrain (1 wire), Winkelpress (2 wires), and Cascade S (both types in series) (available from Bellmer and Corner); HC Press, Gap Washer, and TwinWire (with Paraformer headbox) (available from Metso Paper/Fiber and Phoenix Process Equipment); Salter Belt Press (available from Salter); DNT Washer (available from Thermo Black Clawson); VarioSplit (available from Voith Paper); and Osprey (available from William Jones, London).

One preferred design for use in the inventive method is the VarioSplit type apparatus. German OS 30 05 681 and the publication "VarioSplit, eine neue Maschine zur Verbesserung von AP-Rohstoffen" in "Wochenblatt für Papierfabrikation" volume 21/1981 p. 787-796 describe the VarioSplit, which is suitable for washing aqueous fiber stock suspensions obtained from waste paper and which also can be applied for thickening of such suspensions (OS 30 05 681 column 2, lines 30 to 34, column 2, line 68 to column 3, line 41). A typical stock suspension to be treated is stated to have a consistency of less than 1.5%, preferably 0.4 to 0.8% (column 3, lines 61 to 67).

The "VarioSplit" apparatus comprises, according to a preferred embodiment, an endless wire or filter band having an outer surface which co-operates with a substantial portion of the surface of a rotatable cylinder, a flat jet nozzle forming a flat suspension jet which is introduced into a substantially wedge-shaped intermediate space between the outer surface of the wire band and the cylinder, a take-off roll, a catch container for the pressed-out water, means for collecting the thickened pulp and three guide rolls (column 2, last line to column 3, line 41 and the single figure). For washing a stock suspension the apparatus is operated in such a way that the fiber web formed between the outer surface of the wire band and the cylinder has a weight of less than 100 g/m$^2$, preferably 30 to 70 g/m$^2$, and the wire speed and the circumferential speed of the cylinder is in the order of 400 to 1200 m/min (claim 1 and column 3, last line to column 4, line 8).

The use of a belt filter in the inventive method allows for efficient high-capacity fractionation of highly refined cellulose pulps. The use of a belt filter allows for fractionation of highly refined cellulose pulps at a scale and speed sufficient for commercial production.

In some embodiments, the belt filter comprises a wire belt having an air permeability above 4000 m$^3$/m$^2$/hour at 100 Pa.

In some embodiments, the belt of the belt filter moves at rate of at least 50 m/m in, preferably at least 100 m/min, and more preferably at least 200 m/min. It is preferred that the belt filter is a high-speed belt filter that can be operated at high speed.

In some embodiments, the dwell time of the highly refined cellulose pulp on the belt is below 7 seconds, preferably below 5 seconds, more preferably below 3 seconds.

In some embodiments, the belt filter is a single-wire or twin-wire type belt filter. A single-wire type belt filter drains the water from the pulp suspension through a single wire. A twin-wire type belt filter, sandwiches the pulp between two wires, allowing drainage through both wires.

The starting material of the inventive method is a highly refined cellulose pulp suspension. Refining, or beating, of cellulose pulps refers to mechanical treatment and modification of the cellulose fibers in order to provide them with desired properties. The highly refined cellulose pulp suspension is an aqueous suspension comprising a water-suspended mixture of cellulose based fibrous material and optionally non-fibrous additives. The pulp suspension can be produced from different raw materials, for example selected from the group consisting of bleached or unbleached softwood pulp or hardwood pulp, Kraft pulp, pressurized groundwood pulp (PGW), thermomechanical (TMP), chemi-thermomechanical pulp (CTMP), neutral sulfite semi chemical pulp (NSSC), broke, or recycled fibers.

The term highly refined cellulose pulp as used herein refers to a cellulose pulp which has been subjected to considerable refining, but not to the extent that all of the cellulose pulp will pass through a 200 mesh screen (equivalent hole diameter 76 μm) of a conventional laboratory fractionation device (SCAN-CM 66:05). Preferably no more than 75% of the highly refined cellulose pulp will pass through a 200 mesh screen of a conventional laboratory fractionation device according to SCAN-CM 66:05. More preferably no more than 50% of the highly refined cellulose pulp will pass through a 200 mesh screen of a conventional laboratory fractionation device according to SCAN-CM 66:05. Thus, the highly refined cellulose pulp will comprise a mixture of finer particles and coarser particles. The size distribution of the particles in the highly refined cellulose pulp may depend on the starting material and the refining processes used.

The term highly refined cellulose pulp as used herein refers to a cellulose pulp having a Schopper-Riegler (SR) number above 40 as determined by standard ISO 5267-1. The highly refined cellulose pulp has a Schopper-Riegler (SR) number in the range of 40-98 as determined by standard ISO 5267-1. In some embodiments, the SR number of the highly refined cellulose pulp provided in step a) is in the range of 50-98, preferably in the range of 55-94, and more preferably in the range of 60-92 as determined by standard ISO 5267-1.

The highly refined cellulose pulp has a content of fibers having a length>0.2 mm of at least 7 million fibers per gram based on dry weight, preferably at least 9 million fibers per gram based on dry weight, and more preferably at least 15 million fibers per gram based on dry weight. The content of fibers having a length>0.2 mm may for example be determined using the L&W Fiber tester Plus instrument (L&W/ABB).

In some embodiments, the highly refined cellulose pulp has a mean fibril area of fibers having a length>0.2 mm of at least 15%, preferably at least 17%, more preferably at least 20%. The mean fibril area is determined using the Fiber Tester Plus instrument. "Mean fibril area" as used herein refers to length weighted mean fibril area.

The dry solids content of the highly refined cellulose pulp suspension may be comprised solely of highly refined cellulose pulp, or it can comprise a mixture of the highly refined cellulose pulp and other ingredients or additives.

The highly refined cellulose pulp suspension includes highly refined cellulose as its main component based on the total dry weight of the pulp suspension. In some embodiments, the highly refined cellulose pulp suspension comprises at least 50% by dry weight, preferably at least 70% by dry weight, more preferably at least 80% by dry weight or at least 90% by dry weight of highly refined cellulose, based on the total dry weight of the highly refined cellulose pulp suspension. In some embodiments, the highly refined cellulose pulp suspension comprises in the range of 50-99% by dry weight, preferably in the range of 70-99% by dry weight, more preferably in the range of 80-99% by dry weight, and more preferably in the range of 90-99% by dry weight of highly refined cellulose, based on the total dry weight of the highly refined cellulose pulp suspension.

The highly refined cellulose pulp suspension may further comprise hemicellulose and/or lignin.

In some embodiments, the highly refined cellulose pulp suspension has a lignin content of up to 10% by weight, based on the total dry weight of the highly refined cellulose pulp suspension.

In some embodiments, the highly refined cellulose pulp suspension has a hemicellulose content in the range of 10-30% by weight, based on the total dry weight of the highly refined cellulose pulp suspension.

The highly refined cellulose pulp suspension may further comprise additives such as native starch or starch derivatives, cellulose derivatives such as sodium carboxymethyl cellulose, a filler, flocculation additives, deflocculating additives, dry strength additives, softeners, cross-linking aids, sizing chemicals, dyes and colorants, wet strength resins, fixatives, de-foaming aids, microbe and slime control aids, or mixtures thereof. The inventive method provides an alternative way of increasing dewatering speed, which is less dependent on the addition of retention and drainage chemicals, but smaller amounts of retention and drainage chemicals may still be used. In some embodiments, the highly refined cellulose pulp suspension is free from added retention and drainage chemicals.

The highly refined cellulose pulp suspension preferably comprises no more than 20% by dry weight of additives in total, based on the total dry weight of the highly refined cellulose pulp suspension. More preferably the highly refined cellulose pulp suspension comprises no more than 10% by dry weight of additives in total, based on the total dry weight of the highly refined cellulose pulp suspension.

The highly refined cellulose pulp suspension for use with the inventive method should have a consistency in the range of 0.1-1.5 wt %. Lower consistencies are not convenient for preparing webs of suitable grammage in the belt filter, and higher consistencies will make it difficult to efficiently drain water together with cellulose fines from the web. A consistency in the range of 0.1-1.5 wt % has been found to provide a suitable balance between grammage and efficient drainage of water together with cellulose fines. In some embodiments, the consistency of the highly refined cellulose pulp suspension provided in step a) is in the range of 0.1-1.5 wt %, preferably in the range of 0.1-1 wt %, preferably in the range of 0.2-0.8 wt %, more preferably in the range of 0.2-0.6 wt %.

The present invention is based on the idea of rapidly dewatering the pulp such that a large portion of the fines are removed from the pulp with the filtrate. In the inventive method, the filtrate removed from the pulp during the dewatering comprises a relatively high portion of the solids of the highly refined cellulose pulp suspension. In other words, a significant portion of the cellulose fines are removed from the pulp with the filtrate. The filtrate removed from the web contains in the range of 0.1-50 wt % of the solids of the highly refined cellulose pulp suspension starting material. It is preferred that the collected fine fraction contains 2-50 wt %, preferably 2-40 wt %, even more preferred between 2-30 wt %, more preferably at least 5-30 wt % and even more preferably at least 10-20 wt % of the solids of the highly refined cellulose pulp suspension provided in step a).

During the dewatering in step b), water is preferably removed to a consistency of at least 5 wt %. In some embodiments, the consistency of the dewatered retentate collected in step c) is at least 5 wt %, preferably at least 7.5 wt %, more preferably at least 10 wt %.

The mean particle size of the fine fraction is significantly lower than the mean particle size of the coarse fraction.

Due to the removal of fine material during the dewatering, the dewatered pulp will typically exhibit lower water retention than a pulp in which the fines had been retained to a greater extent. In some embodiments, the collected coarse fraction has a Schopper-Riegler (SR) number below 95, preferably below 90, more preferably below 85, as determined by standard ISO 5267-1.

The term fines as used herein generally refers to cellulosic particles significantly smaller in size than cellulose fibers. The fine fraction collected in step d) may for example comprise cellulose fines or microfibrillated cellulose (MFC).

In some embodiments, the term fines as used herein refers to fine cellulosic particles, which are able to pass through a 200 mesh screen (equivalent hole diameter 76 μm) of a conventional laboratory fractionation device (SCAN-CM 66:05). There are two major types of fiber fines, namely primary and secondary fines. Primary fines are generated during pulping and bleaching, where they are removed from the cell wall matrix by chemical and mechanical treatment. As a consequence of their origin (i.e., compound middle lamella, ray cells, parenchyma cells), primary fines exhibit a flake-like structure with only minor shares of fibrillar material. In contrast, secondary fines are generated during the refining of pulp. Both primary and secondary fines have a negative influence on dewatering in the forming section of a paper machine. Because of their large specific surface area in comparison to pulp fibers, fines also consume a high proportion of chemical additives used in pulp and paper production.

In some embodiments, the fines comprise microfibrillated cellulose (MFC). Microfibrillated cellulose (MFC) shall in the context of the patent application mean a cellulose particle, fiber or fibril having a width or diameter of from 20 nm to 1000 nm.

Various methods exist to make MFC, such as single or multiple pass refining, pre-hydrolysis followed by refining or high shear disintegration or liberation of fibrils. One or several pre-treatment steps is usually required in order to make MFC manufacturing both energy efficient and sustainable. The cellulose fibers of the pulp used when producing MFC may thus be native or pre-treated enzymatically or chemically, for example to reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CM), aldehyde and/or carboxyl groups (cellulose obtained by N-oxyl mediated oxidation, for example "TEMPO"), or quaternary ammonium (cationic cellulose). After being modified or oxidized in one of the above-described methods, it is easier to disintegrate the fibers into MFC.

MFC can be produced from wood cellulose fibers, both from hardwood and softwood fibers. It can also be made from microbial sources, agricultural fibers such as wheat straw pulp, bamboo, bagasse, or other non-wood fiber sources. It can be made from pulp, including pulp from virgin fiber, e.g. mechanical, chemical and/or thermomechanical pulps. It can also be made from broke or recycled paper.

The fines may further comprise hemicellulose and/or lignin.

In some embodiments, the fines have a lignin content of up to 10% by weight, based on the total dry weight of the fines.

In some embodiments, the fines have a hemicellulose content in the range of 10-30% by weight, based on the total dry weight of the fines.

In some embodiments, the fine fraction is able to pass through a 200 mesh screen.

The inventive method is useful for decreasing the water retention of a cellulose pulp containing of fines. The refining processes used for preparing highly refined cellulose pulps may also lead to large variations in fines content. As the fines have a large impact on the properties of the highly refined pulp and on films made from the pulp, removing some of the fines may also lead to a material with more homogeneous properties. In other words, the inventive method may be used for decreasing the water retention and/or increasing the homogeneity of a highly refined cellulose pulp. In order to further tailor the properties to the highly refined pulp and films made from the treated pulp, some of the fines removed from the pulp may be added back to the coarse fraction. In some cases, addition of fines can be done to obtain a desired fines content in the pulp, e.g. for obtaining certain barrier properties in a film subsequently made from the pulp. In some cases, the addition of fines can be done to compensate for variations in fines content of the coarse fraction due to, e.g., variations in the starting material fines content or to variations in the dewatering efficiency.

Thus, in some embodiments the method comprises decreasing the water retention and/or increasing the homogeneity of a highly refined cellulose pulp, said method comprising:

a) providing a highly refined cellulose pulp suspension comprising highly refined cellulose pulp having a Schopper-Riegler (SR) number in the range of 40-98 as determined by standard ISO 5267-1 and a content of fibers having a length >0.2 mm of at least 7 million fibers per gram based on dry weight;
b) subjecting the highly refined cellulose pulp suspension to dewatering in a belt filter;
c) collecting the dewatered retentate as the coarse fraction;
d) collecting the filtrate as the fine fraction, wherein the collected fine fraction contains 2-50 wt % of the solids of the highly refined cellulose pulp suspension provided in step a); and
e) adding a portion of cellulose fines obtained from the fine fraction to the coarse fraction to obtain a highly refined cellulose pulp with decreased water retention and/or increased homogeneity.

In some embodiments, the amount of cellulose fines added to the coarse fraction in step e) is less than the amount of cellulose fines collected in step d), preferably in the range of 1-75% of the amount of cellulose fines collected in step d), more preferably in the range of 1-50% of the amount of cellulose fines collected in step d).

In some embodiments, the pulp obtained in step e) has a lower Schopper-Riegler (SR) number than the highly refined cellulose pulp provided in step a).

In some embodiments, the pulp obtained in step e) has a lower water retention value (WRV) than the highly refined cellulose pulp provided in step a).

The highly refined cellulose pulp is preferably produced from never dried pulp. Never dried pulp has many benefits, but one drawback is that never dried pulps are more difficult to dewater compared to dried pulps. It was found that it is possible to dewater highly refined cellulose pulp from never dried pulp with the method according to the invention in a good way.

According to a second aspect illustrated herein, there is provided a refined cellulose pulp with decreased water retention and/or increased homogeneity obtainable by the inventive method of the first aspect.

The highly refined cellulose pulp obtainable by the inventive method may advantageously be used for manufacturing a barrier film.

According to a third aspect illustrated herein, there is provided the use of a highly refined cellulose pulp with decreased water retention and/or increased homogeneity obtained by the method according to the first aspect in the manufacture of a barrier film.

A problem with webs and films formed from highly refined cellulose pulps, particularly highly refined cellulose pulps having a Schopper-Riegler (SR) number above 80, is that they will typically exhibit poor tensile and tearing strength. It has now been found that a web formed from a highly refined cellulose pulp with reduced fines formed in accordance with the inventive method will have a significantly higher tearing strength than a corresponding web formed from the entire pulp with the fines retained. It has been found that with the inventive method a substrate web having a tear index geometrical mean (i.e. (tear index (md)×tear index (cd))$^{1/2}$) above 3.5 mNm$^2$/g, preferably above 4 mNm$^2$/g and more preferably above 5 mNm$^2$/g, can be formed from a highly refined pulp having an SR number above 80. The tear index geometrical mean will typically be below 10 mNm$^2$/g.

The inventive method allows for efficient manufacturing a barrier film comprising highly refined cellulose in a paper machine type of process. Such films have been found to be very useful, e.g., as gas barrier films in packaging applications. The films can be used to replace conventional barrier films, such as synthetic polymer films or aluminum foils which reduce the recyclability of paper or paperboard packaging products. The inventive films have high repulpability, providing for high recyclability of the films and paper or paperboard packaging products comprising the films.

The term barrier film as used herein refers generally to a thin continuous sheet formed material with low permeability for gases and/or liquids. Depending on the composition of the pulp suspension, the film can also be considered as a thin paper or even as a membrane.

The barrier film can be used as such, or it can be combined with one or more other layers. The film is for example useful as a barrier layer in a paperboard based packaging material. The barrier film may also be or constitute a barrier layer in glassine, greaseproof paper or a thin packaging paper.

Although different arrangements for performing the steps of the inventive method could be contemplated by the skilled person, the inventive method may advantageously be performed in a paper machine, more preferably in a Fourdrinier paper machine.

According to a fourth aspect illustrated herein, there is provided a barrier film formed from a highly refined cellulose pulp obtainable by the inventive method of the first aspect.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

EXAMPLES

Example 1 (Comparative)

Highly refined softwood pulp refined to an SR value >90 and having a fibril area of about 20% (>0.2 mm) and an amount of fibers of about 15 million per gram of sample (>0.2 mm) determined using the L&W Fiber tester Plus instrument (L&W/ABB), was prepared at a pH about 7 and consistency of 1.7 wt % and run on a pilot paper machine. The specific formation was 0.51, which is relatively good, and the tensile index ratio (md/cd) of the formed film was about 2. The results are presented in Table 1.

This example showed that a dense barrier film can be prepared from the highly refined pulp, but because the drainage resistance of the pulp is very high, the machine speed had to be kept very low (30 m/min), and hence web manufacturing will be very slow.

Example 2 (Comparative)

Highly refined softwood pulp refined to an SR value >90 and having a fibril area of about 20% (>0.2 mm) and an amount of fibers of about 15 million per gram of sample (>0.2 mm) determined using the L&W Fiber tester Plus instrument (L&W/ABB), was prepared at a pH about 7 and consistency of 1.7 wt % and run on a full-scale paper machine with a fourdrinier layout. The specific formation was about 0.7 and tensile index ratio about 2.

The machine speed had to be reduced to about 130 m/min due to high drainage resistance of the pulp. The amount of solids removed through the wire during dewatering was about 2 wt % of the solids of the highly refined cellulose pulp used as starting material.

The results in Table 1 below show that a dense sheet can be made, but due to high drainage resistance, the manufacturing speed is low and the formation and evenness of the base is also impacted negatively.

Example 3

Highly refined softwood pulp refined to an SR value >90 and having a fibril area of about 20% (>0.2 mm) and an amount of fibers of about 15 million per gram of sample (>0.2 mm) determined using the L&W Fiber tester Plus instrument (L&W/ABB), was prepared and diluted to a consistency of 0.5-0.6 wt % and run at a pH of 6.5-8 at a temperature in the range of 37-44° C. in a twin-wire hybrid former at a speed of 500 m/m in.

The concentration of solids in the white water removed from the pulp during the dewatering was about 0.05 wt %, which means that the amount of solids removed through the wire during dewatering was about 10 wt % of the solids of the highly refined cellulose pulp used as starting material.

This example confirms that a web containing high amount of highly refined pulp can be dewatered at higher speed, and that this leads to a web with increased air permeability due to removal of a significant portion of the fine solids from the pulp (i.e. fractionation).

Interestingly, it was noted that the specific formation was 0.43, which is very good and tensile index ratio was 3.75, which is very high. Also, the tearing resistance was very good, confirming that subjecting the pulp to fractionation has a positive effect on the web strength.

Example 4 (Comparative)

Softwood pulp refined to a SR of 82 and having a fibril area of about 17% (>0.2 mm) and an amount of fibers of about 11 million per gram (>0.2 mm) determined using the L&W Fiber tester Plus instrument (L&W/ABB), was prepared to a sheet in a Formette unit (lab device). The grammage of the formed sheet was 30 gsm. The OTR determined at 23° C./50% RH for the sheet was 189 cc/m$^2$/day, which confirms that the sheet has some barrier properties but is not on the same level as in comparative Example 1. This is mainly due to slightly coarser fiber material than in Example 1.

Example 5

This example was performed in order to demonstrate the effect of coating a substrate web formed from a highly refined cellulose pulp with a coating comprising fine cellulosic material in the form of microfibrillated cellulose (MFC).

This example used same refined softwood pulp as in Example 4. A 25 gsm sheet was formed from the pulp in a Formette unit and a 5 gsm MFC layer was subsequently applied on the sheet using a spray device. The MFC was prepared by treating softwood fiber with enzyme (cellulase) prior to high pressure fluidization. The MFC coating was applied to the substrate web after dewatering, but before drying. The basis weight of substrate web was 25 gsm, and the amount of MFC applied to the web was 5 gsm. The OTR determined at 23° C./50% RH for the coated sheet was 3, which confirmed the effect of applying a fine MFC to the sheet surface.

Example 6

Example 1 was repeated on a pilot paper machine but now with a 30% addition of unrefined softwood pulp to the highly refined cellulose pulp. This gave a highly porous substrate web with no barrier properties.

Subsequently, an MFC coating as used in Example 5 was applied to the dewatered but not dried web by wet curtain coating.

The OTR of the coated substrate determined at 23° C./50% RH was 565 cc/m$^2$/day. This relatively low OTR confirmed that the MFC coating can close the surface despite a very high particle/fiber size distribution in the substrate web as represented by the addition of 30% of unrefined fiber to the highly refined pulp.

TABLE 1

| | 1 | 2 | 3 | 4 (Formette) | 5 (Formette) | 6 |
|---|---|---|---|---|---|---|
| Furnish | | | | | | |
| Refined pulp (SR > 90) | 100% | 100% | 100% | | | 70% |
| Refined pulp (SR 82) | | | | 100% | 100% | |
| Pulp (softwood) | | | | | | 30% |
| Coating (wet on wet) | | | | | Yes | Yes |
| Dewatering | Single wire | Single wire | Twin wire | Single wire | Single wire | Single wire |
| Fiber fraction removed | <1% | <2% | 10% | N.D. | N.D. | N.D. |
| Speed, m/min | 30 | 130 | 500 | N.D. | N.D. | 30 |
| Sheet properties | | | | | | |
| Grammage, g/m$^2$ | 31 | 31.8 | 37 | 30 | 25 + 5 | 32 |
| Density | | 725 | 899 | N.D. | N.D. | N.D. |
| Gurley Hill s/100 ml | N.D. | 42300 | 5614 | N.D. | N.D. | N.D. |

TABLE 1-continued

| | 1 | 2 | 3 | 4 (Formette) | 5 (Formette) | 6 |
|---|---|---|---|---|---|---|
| OTR, 23/50 cc/m$^2$/day | 7 | Fail/ >3100 | Fail/ >3100 | 189 | 3 | 565 |
| Specific Formation | 0.51 | 0.73 | 0.43 | N.D. | N.D. | N.D. |
| Tensile index, md | 117 | 90.4 | 105 | N.D. | N.D. | N.D. |
| Tensile index, cd | 54.7 | 45 | 28 | N.D. | N.D. | N.D. |
| Tensile strength, Geometric mean | 2.49 | 2.03 | 1.99 | N.D. | N.D. | N.D. |
| Tensile index ratio (md/cd) | 2.1 | 2 | 3.75 | N.D. | N.D. | N.D. |
| Tearing index, cd | 3.6 | 3.5 | 4.7 | N.D. | N.D. | N.D. |
| Tearing index, md | 3 | 3.4 | 6.6 | N.D. | N.D. | N.D. |
| Tearing resistance, Geometric mean | 101 | 110 | 206 | N.D. | N.D. | N.D. |

Tensile index (Nm/g): ISO 1924-3
Specific Formation (g^0.5/m): SCAN-P 92
Tear index (mNm$^2$/g): ISO 1974
Grammage (g/m$^2$): ISO 536
Tearing resistance (mN): ISO 1974
Air resistance (s/100 ml), Gurley Hill: ISO 5636/5
Bulk, single sheet (cm$^3$/g): ISO 534
md = machine direction
cd = cross direction
N.D. = Not determined

The invention claimed is:

1. A method for fractionation of a highly refined cellulose pulp into a fine fraction and a coarse fraction, said method comprising:

a) providing a highly refined cellulose pulp suspension comprising highly refined cellulose pulp having a Schopper-Riegler (SR) number in a range of 60-98 as determined by standard ISO 5267-1 and a content of fibers having a length >0.2 mm of at least 7 million fibers per gram based on a dry weight;

b) subjecting the highly refined cellulose pulp suspension to dewatering in a belt filter;

c) collecting a dewatered retentate as a coarse fraction; and d) collecting a filtrate as a fine fraction;

wherein the fine fraction contains 2-50 wt % of the solids of the highly refined cellulose pulp suspension provided in step a).

2. The method according to claim 1, wherein the highly refined cellulose pulp provided in step a) has a Schopper-Riegler (SR) number in a range of 60-92, as determined by standard ISO 5267-1.

3. The method according to claim 1, wherein the fine fraction contains 5-40 wt % or 10-30 wt % of the solids of the highly refined cellulose pulp suspension provided in step a).

4. The method according to claim 1, wherein a consistency of the highly refined cellulose pulp suspension provided in step a) is in a range of 0.1-1.5 wt %.

5. The method according to claim 1, wherein a consistency of the retentate collected in step c) is at least 5 wt %.

6. The method according to claim 1, wherein the coarse fraction has a Schopper-Riegler (SR) number below 95, as determined by standard ISO 5267-1.

7. The method according to claim 1, wherein the fine fraction is able to pass through a 200 mesh screen.

8. The method according to claim 1, wherein the belt filter comprises a wire belt having an air permeability above 4000 m$^3$/m$^2$/hour at 100 Pa.

9. The method according to claim 1, wherein a belt of the belt filter moves at a rate of at least 50 m/min.

10. The method according to claim 1, wherein a dwell time of the highly refined cellulose pulp on a belt of the belt filter is below 7 seconds.

11. The method according to claim 1, wherein the belt filter is a single-wire or twin-wire type belt filter.

12. The method according to claim 1, wherein a portion of cellulose fines obtained from the fine fraction is added to the coarse fraction to obtain a highly refined cellulose pulp with a decreased water retention, or an increased homogeneity, or both.

13. The method according to claim 12, wherein an amount of cellulose fines added to the coarse fraction is less than an amount of cellulose fines collected in step d).

14. The method according to claim 12, wherein a pulp obtained after addition of the portion of the cellulose fines has a lower Schopper-Riegler (SR) number than the highly refined cellulose pulp provided in step a).

15. The method according to claim 12, wherein a pulp obtained after addition of the portion of the cellulose fines has a lower water retention value (WRV) than the highly refined cellulose pulp provided in step a).

16. A method for fractionation of a highly refined cellulose pulp into a fine fraction and a coarse fraction, said method comprising:

a) providing a highly refined cellulose pulp suspension comprising highly refined cellulose pulp having a Schopper-Riegler (SR) number in a range of 40-98 as determined by standard ISO 5267-1 and a content of fibers having a length >0.2 mm of at least 7 million fibers per gram based on a dry weight;

b) subjecting the highly refined cellulose pulp suspension to dewatering in a belt filter;

c) collecting a dewatered retentate as a coarse fraction; and d) collecting a filtrate as a fine fraction;

wherein the fine fraction contains 2-50 wt % of the solids of the highly refined cellulose pulp suspension provided in step a), and wherein the fine fraction is able to pass through a 200 mesh screen.

* * * * *